United States Patent [19]

Stark

[11] 3,969,857

[45] July 20, 1976

[54] TAMPER-PROOF WINDOW UNIT

[75] Inventor: Carroll G. Stark, North Hollywood, Calif.

[73] Assignee: Anemostat Products Division Dynamics Corporation of America, Scranton, Pa.

[22] Filed: Oct. 15, 1975

[21] Appl. No.: 622,758

[52] U.S. Cl. ..... 52/208; 52/212; 52/217; 52/656

[51] Int. Cl.[2] ..... E06B 3/58; E06B 3/26

[58] Field of Search ..... 52/208, 210–214, 52/217, 397, 482, 628, 656; 49/171, 505

[56] References Cited

UNITED STATES PATENTS

| | | | |
|---|---|---|---|
| 2,614,665 | 10/1952 | Floyd | 52/217 X |
| 2,693,257 | 11/1954 | Bongiovanni | 52/482 X |
| 2,773,571 | 12/1956 | Kelly | 52/217 X |
| 2,831,553 | 4/1958 | Pollock | 52/482 X |
| 2,834,997 | 5/1958 | Webb | 52/212 X |
| 2,871,524 | 2/1959 | Wille et al. | 52/397 X |
| 2,944,305 | 7/1960 | Avery | 52/212 |
| 3,184,801 | 5/1965 | Fletcher | 52/209 |
| 3,203,052 | 8/1965 | Curtis, Jr. | 49/171 X |
| 3,363,365 | 1/1968 | Laepple | 52/212 X |
| 3,566,565 | 3/1971 | Pond | 52/208 |
| 3,760,543 | 9/1973 | McAllister | 52/397 |
| 3,861,099 | 1/1975 | Faudree | 52/213 X |

FOREIGN PATENTS OR APPLICATIONS

| | | | |
|---|---|---|---|
| 528,551 | 8/1955 | Italy | 52/208 |
| 470,170 | 3/1952 | Italy | 52/656 |
| 276,345 | 2/1951 | Switzerland | 52/208 |

*Primary Examiner*—Ernest R. Purser
*Assistant Examiner*—Leslie A. Braun
*Attorney, Agent, or Firm*—McCormick, Paulding & Huber

[57] ABSTRACT

A tamper-proof window unit comprising similar first and second quadrilateral centrally open frame members adapted to be mounted about an opening respectively on opposite sides of a door. Each frame member has a narrow elongated quadrilateral front panel extending generally in a plane parallel to the door and marginally about the door opening with an outer edge portion partially overlapping the door adjacent the opening. A small countersunk front to rear screw hole is provided in each side of front panel of a first frame member and the opening is spaced inwardly from the outer edge of the panel so as to communicate with the door opening. A narrow elongated quadrilateral integral flange extends along and projects rearwardly toward the door from an outer edge of each front panel. A second narrow elongated quadrilateral and generally L-shaped integral flange extends along the inner edge of each front panel with each L-shaped flange comprising first and second panels. The first panel of each L-shaped flange projects generally rearwardly from its associated front panel but at a slight angle of inclination toward the center of the door opening. The second panel projects from the rear or inner edge of the first panel outwardly with respect to the center of the door opening and in a plane generally parallel with the door faces and the front panels.

12 Claims, 5 Drawing Figures

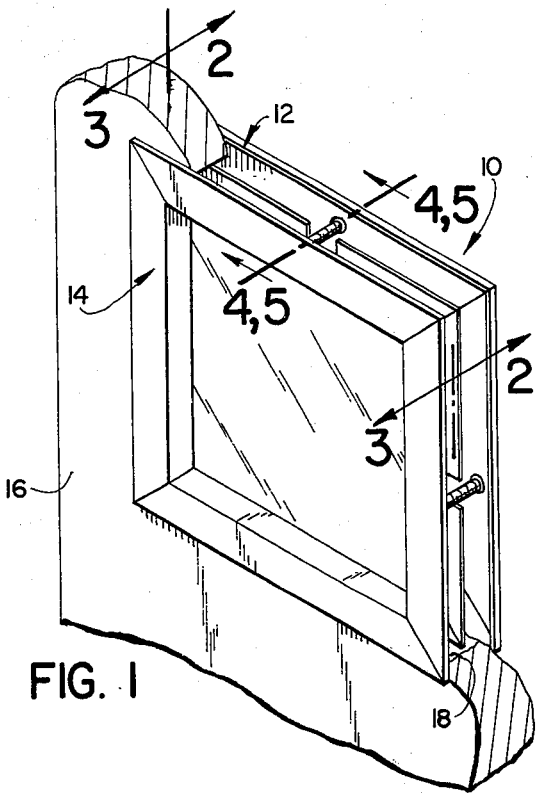
FIG. 1
FIG. 2
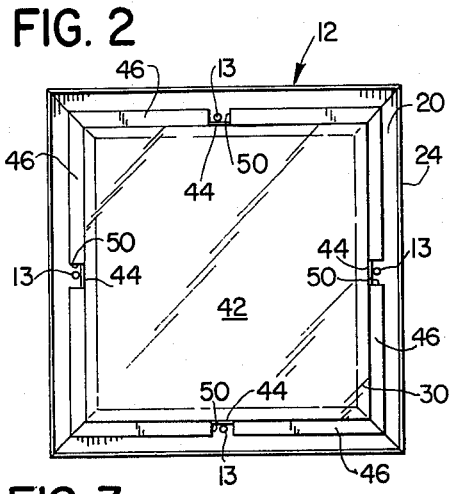
FIG. 3
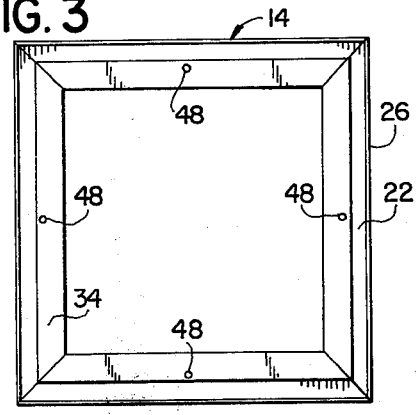
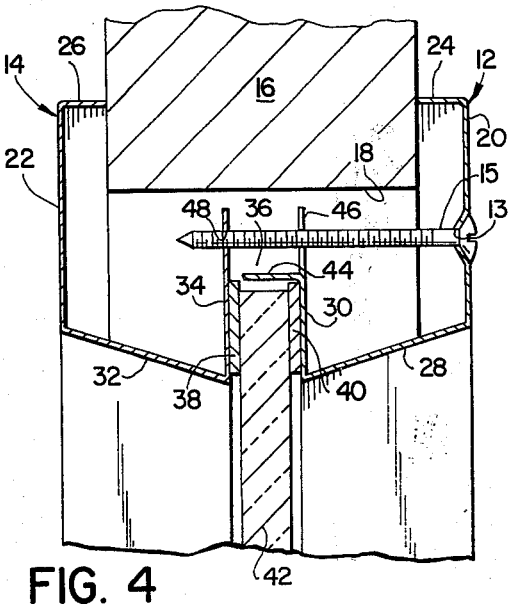
FIG. 4
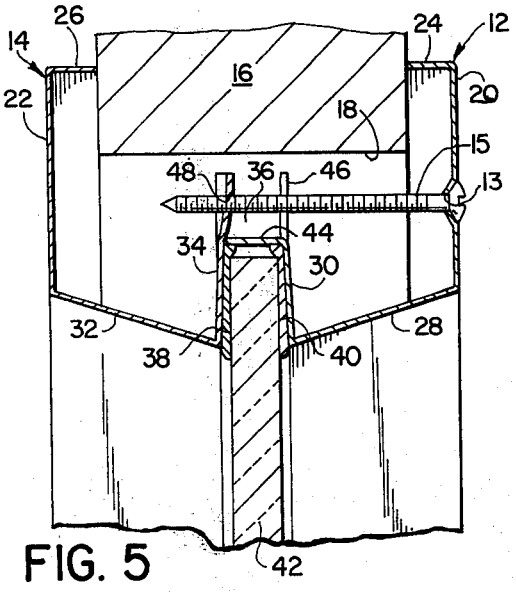
FIG. 5

TAMPER-PROOF WINDOW UNIT

BACKGROUND OF THE INVENTION

Tamper-proof window units for use in steel doors and the like have been available in the past and have been generally satisfactory. Such units, however, have normally employed tamper-proof bolts which have not always wholly obviated tampering and which have required drilling through the steel doors adjacent the window openings, providing hole layouts or templates to align door and window frame holes and, in the case of U.L. labelled fire doors, pre-drilling at the factory prior to shipment has been required. Still further, maintaining the parts of the window frame and the associated pane of glass in desired relative positions during shipment and installation has proven unwieldy and somewhat inefficient.

SUMMARY OF THE INVENTION

The general object of the present invention is to provide an improved tamper-proof window unit having no visible means of attachment from one side and wherein attachment screws are positioned within the door opening eliminating the need for drilled holes, layouts, templates, etc., and wherein a simple and yet effective means is provided for maintaining frame parts and the window pane in desired relative positions during shipment and installation prior to final assembly.

BRIEF DESCRIPTION OF THE DRAWINGS

FIG. 1 is a perspective view partially broken away for clarity and illustrating a window unit constructed in accordance with the present invention and a portion of a door associated with the unit.

FIG. 2 is a sectional view taken generally as indicated at 2—2 in FIG. 1 and showing a first window frame member and an associated pane of glass.

FIG. 3 is a sectional view taken generally as indicated at 3—3 in FIG. 1 and showing a second window frame member.

FIG. 4 is an enlarged fragmentary sectional view taken generally as indicated at 4—4 in FIG. 1 and showing both the first and second frame members, the pane of glass, and an edge portion of a door in a condition of partial assembly.

FIG. 5 is an enlarged sectional view similar to FIG. 4 but showing the parts in final assembly.

DETAILED DESCRIPTION OF THE PREFERRED EMBODIMENT

Referring particularly to FIG. 1, it will be observed that a tamper-proof window unit constructed in accordance with the present invention is indicated generally at 10 and comprises similar first and second similar frame members 12 and 14. The tamper-proof unit is adapted for assembly in doors, partitions, etc., and, as shown in FIG. 1 the unit is assembled in a door 16 with the tamper-proof side toward the viewer. The door may be of steel or other construction and has a multilateral window opening 18, shown in the common form of a quadrilateral or four-sided opening. In accordance with the invention, the window unit is multilateral, and may include a three-sided configuration, a four-sided configuration, etc., and even circular and other arcuate forms which may be regarded as comprising an infinite number of sides.

With a quadrilateral window opening as shown the window frame members 12 and 14 are of course also of a quadrilateral configuration and are preferably formed from bent sheet metal although materials of construction may vary widely within the scope of the invention. As stated the frame members 12 and 14 are similar and in the preferred form shown, the said frame members are of identical cross section throughout in their initial stages of forming. Thus, the frame members may be constructed at economic advantage, for example by roll forming or press-brake forming, miter-cut and welded or otherwise joined at corners to provide finished frame members. The first frame member 12 has four small countersunk front to rear openings 13,13 and four screws 15,15 have their heads exposed. Thus, the first frame member may be on an interior or private side of the door 16 while the second frame member 14 has no visible means of attachment and is adapted for the public or tamper-proof side of the door.

Each of the first and second frame members has a front panel which is multilateral, quadrilateral as shown, and which takes a narrow elongated configuration extending generally in a plane parallel to the door and marginally about the door opening with an outer edge partially overlapping the door adjacent the opening. Such panels are shown at 20, 22 respectively for the frame members 12, 14 and each panel has top, bottom, left and right hand sides. To provide a finished edge, the outer edge of each of the front panels 20, 22 includes a narrow elongated flange which projects rearwardly toward the door. Such flanges are shown for the panels 20,22 respectively at 24, 26 and each of the flanges has top, bottom, left and right hand sides.

Each frame member also has a narrow elongated generally L-shaped integral flange which extends along the inner edge of its front panel and each such flange comprises integral first and second narrow elongated panels. As shown, the front panel 20, FIGS. 4 and 5, has an L-shaped flange with a first panel 28 and an integral second panel 30, while the front panel 22 is provided with an L-shaped flange having a first panel 32 and a second panel 34. Each of the first panels 28, 32 projects generally rearwardly from its associated front panel and, as shown, the flanges 28, 32 project rearwardly and also at a slight angle of inclination inwardly toward the center of the door opening. The second panels 30, 34 project from a rear or inner edge of their respective first panels outwardly with respect to the center of the door opening and in a plane generally parallel with the door faces and the front panels 20, 22.

Still referring to FIGS. 4 and 5, it will be observed that the two second panels 30, 34 are spaced apart in parallel relationship to define a groove 36. The groove 36 opens inwardly toward the center of the door opening and is adapted to receive and hold a marginal portion of a pane of glass. Two small layers of mastic 38 and 40 are shown disposed in the groove respectively between the panels 34, 30 and a pane of glass 42. It will be understood, however, that a single layer of mastic such as illustrated at 38 may suffice in a majority of installations. The pane of glass 42 may of the common window type, an impact resistant polycarbonate, or, preferably of the fire retardant type.

In accordance with the present invention, the second panel of one of the frame members 12, 14 is divided into first and second sections along each of at least two generally opposite sides of the panel and, as shown, the second panel 30 of the frame member 12 is divided into first and second sections along each of its four sides. Each first section of the panel 30 takes the form of a small tab 44 which is arranged substantially at right angles with the panel and which projects rearwardly toward the second panel on the other frame member 14 and adjacent the marginal edge of the pane of glass 42. That is, each tab 44 is severed and bent through approximately 90° from the panel 30 and, as best shown in FIG. 2, each tab 44 is disposed adjacent the marginal portion of the pane of glass 42. The second section of each side of the panel 30, illustrated at 46,46 resides substantially in the plane of the panel.

The second panel 34 of the second frame member 14 is, in accordance with the invention, provided with small front to rear openings in at least two generally opposite sides thereof, and as shown, a small opening 48 is provided in each of the four sides of the panel 34. The openings 48,48 are arranged in front to rear alignment respectively with the aforementioned openings 13,13 in the front panel 20 of the frame member 12. Further, it will be observed that the bending of the tabs 44,44 from the plane of the second panel 30 provides small additional openings or spaces 50,50 vacated by the tabs. The small additional openings 50,50 provide clearance for the screws 15,15, the said screws being entered respectively in the openings 13,13 in the front panel 20 and the openings 48,48 in the second panel 34 of the second frame member 14. Four screws 15,15 are provided as indicated above and may take the form of ordinary sheet metal screws tamper-proof construction being unnecessary.

Referring now particularly to a comparison of FIGS. 4 and 5, it will be observed that the pane of glass 42 is held in position against unintended or accidental movement in its plane in a loosely assembled condition of the parts by the tabs 44,44. When the screws 15,15 in the openings 13,13 and 48,48 are thereafter tightened to the condition of final assembly as shown in FIG. 5, the tabs 44,44 serve a second function as stops engaging the second panel 34 of the frame member 14. With the parts in final assembly as shown in FIG. 5 the outer edge flanges 24,26 of the frame members 12,14 clampingly engage opposite sides of the door 16 and the two second panels 30,34, albeit indirectly, clampingly hold the marginal portions of the pane of glass 42. That is, the marginal portions of the pane of glass are clampingly held indirectly by the opposing engagement of the panels 30,34 on the mastic 38,40. A simple and convenient assembly procedure is thus provided and yet a high degree of structural integrity is achieved in assembled window unit.

As will be apparent from the foregoing, the tabs 44,44 serve the desired purpose of maintaining the pane of glass 42 in its desired relative position during installation and they also serve the additional stop function during final assembly. The necessary additional or clearance opening for the screws 15,15 is conveniently provided for in the bending of the tabs from the second panel 30. With regard particularly to the tamper-proof feature, it will be observed that there is no visible means of attachment from the public side, i.e., the side of the window unit facing the frame member 14 and there is no necessity to drill holes in the door, the screws 15,15 being engaged with the frame members within the door opening 18. Finally, with the use of tamper-proof through bolts eliminated a small but relatively expensive item of construction is eliminated and in the event of loss, the ordinary sheet metal screws can be easily replaced at the installation site.

I claim:

1. A tamper-proof window unit for assembly in multilateral openings in doors and the like; said unit comprising similar first and second multilateral centrally open frame members adapted to be mounted about an opening respectively on opposite sides of a door, each of said frame members comprising a narrow elongated multilateral front panel extending generally in a plane parallel to the door and marginally about the door opening with an outer edge portion partially overlapping the door adjacent the opening, the front panel of said first frame member having a small front to rear opening communicating with the door opening in each of at least two generally opposite sides of the panel, and each frame member also comprising a narrow elongated multilateral generally L-shaped integral flange extending along the inner edge of its said front panel, each L-shaped flange including a first narrow elongated panel which projects generally rearwardly from its associated front panel and a second narrow elongated panel which projects from a rear edge of the first panel outwardly with respect to the center of the door opening and in a plane generally parallel with the door faces and front panels, the two second panels on the opposite frame members being spaced apart in parallel relationship to define a groove which opens inwardly toward the center of the door opening and which is adapted to receive and hold a marginal portion of a pane of glass, a pane of glass disposed in the door and frame opening with a marginal portion thereof entered in said groove, said second panel of one of said frame members having an outer and free edge portion divided into first and second sections along each of at least two generally opposite sides of the panel, each first section being arranged substantially at right angles with the panel and projecting rearwardly toward the second panel on the other frame member and adjacent the marginal edge of the pane of glass, and each second section residing substantially in the plane of the panel, each of at least two generally opposite sides of said second panel of said second frame member having a small front to rear opening therein, said two front to rear openings being aligned in front to rear relationship respectively with the two openings in said front panel sides of said first frame member, and two screws entered and threadably engaged respectively in said aligned openings and serving to secure the window unit and door in assembly with said outer edge portions of said two front panels clampingly engaging opposite sides of the door adjacent its opening and with said two second panels clampingly holding the marginal portions of the pane of glass.

2. A tamper-proof window unit as set forth in claim 1 wherein each of at least two generally opposite sides of said second panel of said first frame member is provided with additional front to rear openings, said two additional openings being in front to rear alignment respectively with said two openings in said front panel of said first frame member and with said two openings in said second panel of said second frame member, and said two screws passing through said additional openings between said front panel openings and said second panel openings in said second frame member.

3. A tamper-proof window unit as set forth in claim 2 wherein said one frame member with said divided second panel is said first frame member, and wherein the first sections on generally opposite sides of said second panel are spaced inwardly from and aligned respectively with said two openings in said front panel of said first frame member and with said two openings in said second panel of said second frame member, said two first sections thus defining spaces in their associated second sections and providing said two additional openings.

4. A tamper-proof window unit as set forth in claim 1 wherein said first sections on said second panel of said one frame member have their rear edges slightly spaced from said second panel of said other frame member with the window unit assembled and the screws loosely entered in their respective openings, said rear edges of said sections engaging said second panels and serving as stops on tightening of said screws.

5. A tamper-proof window unit as set forth in claim 1 wherein divided first and second sections are provided on each of first and second generally opposite pairs of sides of said second panel on said one frame member, the four first sections of said panel thus provided each projecting adjacent the marginal edge of the pane of glass and holding the glass against unintended movement in its plane both during and after assembly.

6. A tamper-proof window unit as set forth in claim 1 wherein a layer of mastic is provided on at least one side of said pane of glass along its marginal edge and in said groove between the glass and at one of said two second panels, the mastic being engaged by said panel during tightening of the screws and the glass thus being indirectly clampingly held by the panels.

7. A tamper-proof window unit as set forth in claim 1 wherein the outer edge portions of the front panels of each of said first and second frame members comprises a narrow elongated multilateral and integral flange extending along the panel edge and projecting rearwardly toward the door, the rear edges of said flanges respectively clampingly engaging the door on opposite sides during tightening of said screws as aforesaid.

8. A tamper-proof window unit as set forth in claim 1 wherein said door opening and said window unit are quadrilateral, wherein each of the four sides of the front panel of said first frame member is provided with a small opening, wherein the L-shaped flange of said one frame member has a second panel with each of its four sides divided into first and second sections, wherein each of the four sides of said second panel of said second frame member has a small front to rear opening, wherein said two groups of four openings are disposed respectively in front to rear alignment, and wherein four screws are provided and threadably engaged respectively in pairs of aligned openings.

9. A tamper-proof window unit as set forth in claim 8 wherein each of said first sections of said second panel on said one frame member takes the form of a small tab severed and bent rearwardly from its associated panel through approximately 90°, said tabs serving both to restrain the glass pane against unintended movement in its plane and as stops on engagement with the second panel on the other frame member.

10. A tamper-proof window unit as set forth in claim 9 wherein said one frame member is said first frame member, and wherein each of said small tabs is bent generally inwardly and rearwardly and arranged between and in front to rear alignment with a front panel opening and an opening in said second panel of said second frame member, the space thus vacated by said tab in its second panel providing an additional opening for the front to rear passage of a screw entered in said two openings.

11. A tamper-proof window unit as set forth in claim 10 wherein a layer of mastic is provided on each side of said pane of glass along its marginal edge and in said groove between the glass and said two second panels, the mastic being engaged by said panels during tightening of the screws and the glass thus being indirectly clampingly held by the panels.

12. A tamper-proof window unit as set forth in claim 10 wherein the outer edge portions of the front panels of each of said first and second frame members comprises a narrow elongated quadrilateral and integral flange extending along the panel edge and projecting rearwardly toward the door, the rear edges of said flanges respectively clampingly engaging the door on opposite sides during tightening of the screws as aforesaid.

* * * * *

UNITED STATES PATENT OFFICE

CERTIFICATE OF CORRECTION

Patent No. 3,969,857 Dated July 20, 1976

Inventor(s) Carroll G. Stark

It is certified that error appears in the above-identified patent and that said Letters Patent are hereby corrected as shown below:

Column 2, line 61, after "42 may" insert -- be --.

Signed and Sealed this

Thirtieth Day of November 1976

[SEAL]

*Attest:*

RUTH C. MASON
*Attesting Officer*

C. MARSHALL DANN
*Commissioner of Patents and Trademarks*